US008265503B2

(12) United States Patent
Yogome

(10) Patent No.: US 8,265,503 B2
(45) Date of Patent: Sep. 11, 2012

(54) APPARATUS AND METHOD FOR ADJUSTING CONCENTRATION OF LIQUID DEVELOPER

(75) Inventor: Keyaki Yogome, Otsu (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 1091 days.

(21) Appl. No.: 12/157,482

(22) Filed: Jun. 11, 2008

(65) Prior Publication Data

US 2008/0317490 A1 Dec. 25, 2008

(30) Foreign Application Priority Data

Jun. 19, 2007 (JP) ..... 2007-161237

(51) Int. Cl.
*G03G 15/10* (2006.01)

(52) U.S. Cl. ..... 399/59; 399/30; 399/238

(58) Field of Classification Search ..... 399/9, 27, 399/30, 38, 53, 57–59, 75, 120, 222, 237, 399/238

See application file for complete search history.

(56) References Cited

U.S. PATENT DOCUMENTS

| | | | | |
|---|---|---|---|---|
| 4,800,839 | A * | 1/1989 | Ariyama et al. | 399/57 |
| 6,131,001 | A * | 10/2000 | Tsukamoto et al. | 399/57 |
| 6,694,112 | B2 * | 2/2004 | Sasaki et al. | 399/57 |
| 2003/0175049 | A1 * | 9/2003 | Ichida et al. | 399/237 |

FOREIGN PATENT DOCUMENTS

| | | |
|---|---|---|
| JP | 06-277477 | 10/1994 |
| JP | 09-281808 | 10/1997 |
| JP | 11-073029 | 3/1999 |

OTHER PUBLICATIONS

U.S. Appl. No. 12/070,688 entitled "Apparatus and Method for Adjusting Concentration of Liquid Developer," filed Feb. 20, 2008.

* cited by examiner

*Primary Examiner* — Walter L Lindsay, Jr.
*Assistant Examiner* — Benjamin Schmitt
(74) *Attorney, Agent, or Firm* — Brinks Hofer Gilson & Lione

(57) ABSTRACT

Provided is a liquid developer concentration adjusting apparatus and a method so that the concentration can be adjusted easily and efficiently without using time and effort in liquid volume control. Further, the apparatus and method enable the concentration adjustment to be efficiently accomplished in a short period of time with reduced volume of required supply developer to be added for the adjustment independently of the initial concentration of the developer by concurrently measuring the concentration of developer, even if the concentration thereof is high. In the control of the concentration adjustment, the developer is allowed to overflow through an opening of the concentration adjusting container, and the concentration adjustment by using supply developer or the supply speed of the supply developer is started before the start of the overflow.

22 Claims, 11 Drawing Sheets

APPARATUS AND METHOD FOR ADJUSTING CONCENTRATION OF LIQUID DEVELOPER

This application is based on Japanese Patent Application No. 2007-161237 filed on Jun. 19, 2007, in Japanese Patent Office, and U.S. patent application Ser. No. 12/070,688 filed on Feb. 20, 2008, in the United States Patent and Trademark Office, the entire contents of which are hereby incorporated by reference.

TECHNICAL FIELD

The present invention relates to a liquid developer concentration adjusting apparatus and a method for adjusting concentration of liquid developer used for image forming in an image forming apparatus.

BACKGROUND

Conventionally, the electrophotographic image forming apparatus using liquid developer has been known. In such an image forming apparatus, an electrostatic latent image is formed on the photoreceptor, and this is developed by liquid developer to a toner image. This toner image is transferred onto paper and is fixed thereon.

The liquid developer is prepared by dispersing toner particles made of resin and pigment into a carrier solution as an insulation solution exemplified by silicone oil in a high concentration. In order to develop an electrostatic latent image with this liquid developer, a thin layer of the developer of microns is formed on a developer carrier such as a development roller, and this thin-film developer is brought into contact with a photoreceptor.

As described above, when the liquid developer is used for development, formation of a uniform thin film of the developer of a predetermined concentration is crucial to obtain images with less variation of image density. To put it another way, it is important to maintain constant concentration of the liquid developer.

One of the techniques known in the conventional art to measure the concentration of the developer to maintain constant concentration of the liquid developer is the technique of calculating the developer concentration by detecting the light transmittance of the developer (Unexamined Japanese Patent Application Publication No. H09-281808 and Unexamined Japanese Patent Application Publication No. H11-73029). However, the method of calculating the developer concentration by light transmittance is accompanied by the problem of poor accuracy in measuring the concentration in the case of highly concentrated developer. This is because, when the developer concentration is low, light transmittance is greatly changed by a change in concentration. However, when the concentration is increased, the light transmittance is reduced to the extent of reaching the point of saturation.

To solve this problem, the U.S. Pat. No. 6,131,001 discloses a method of using the viscosity of the developer to measure the concentration of a highly concentrated developer. The technique disclosed in this document uses, as the method of measuring the viscosity of developer, the method of obtaining the viscosity from the pressure difference of the developer in a pipe, the method of installing a viscometer in the tank accommodating the developer, and the method of obtaining the viscosity from the torque by the flowing developer. However, any of these methods has the problem of complicated structure and lack of sufficient precision.

Further, the Unexamined Japanese Patent Application Publication No. H06-277477 discloses the development of a technique of obtaining the viscosity of highly concentrated slurry (fuel mixture of coal and water) from the rotating torque in stirring operation by rotation, although this is not a liquid developer. However, while the measurement of the rotating torque is comparatively simple, this technique has a defect of requiring the complicated procedure of calculating by detecting the amount of the liquid in a container.

SUMMARY

An object of the present invention is to solve the aforementioned problems and to provide a liquid developer concentration adjusting apparatus and the method thereof wherein concentration can be adjusted easily and efficiently, without requiring much time and effort in liquid volume control, while measuring the concentration of highly concentrated developer. Another object of the present invention is to provide a liquid developer concentration adjusting apparatus and the method thereof wherein concentration can be adjusted quickly and efficiently with reduced supply developer to a desired level, independently of the initial concentration of the developer.

In view of forgoing, one embodiment according to one aspect of the present invention is a liquid developer concentration adjusting apparatus, comprising:

a concentration adjusting container having an opening;

a developer supplying mechanism which is connected to the concentration adjusting container and is adapted to supply liquid developer whose concentration is to be adjusted into the concentration adjusting container;

a first liquid supplying mechanism which is connected to the concentration adjusting container and is adapted to supply first supply liquid, whose concentration is higher than a desired liquid developer concentration, to the concentration adjusting container at a variable supply speed;

a second liquid supplying mechanism which is connected to the concentration adjusting container and is adapted to supply second supply liquid, whose concentration is lower than the desired liquid developer concentration, to the concentration adjusting container at a variable supply speed;

a physical property detector which is adapted to detect a certain physical property which depends on concentration of the liquid developer in the concentration adjusting container;

an OF detector which is adapted to detect a presence or absence of overflow of the liquid developer through the opening; and a controller which is adapted to control a supply speed of the first supply liquid supplied by the first liquid supplying mechanism or the second supply liquid supplied by the second liquid supplying mechanism depending on an output of the OF detector.

According to another aspect of the present invention, another embodiment is a method for adjusting concentration of liquid developer, the method comprising the steps of:

supplying liquid developer whose concentration is to be adjusted to a concentration adjusting container having an opening;

supplying first supply liquid whose concentration is higher than a desired liquid developer concentration to the concentration adjusting container;

supplying second supply liquid whose concentration is lower than the desired liquid developer concentration to the concentration adjusting container;

detecting a physical property which depends on concentration of the liquid developer in the concentration adjusting container;

detecting a presence or absence of overflow of the liquid developer through the opening; and controlling a supply speed of the first supply liquid or the second supply liquid based on the detected physical property and the detected presence or absence of the overflow.

DETAILED DESCRIPTION OF THE PREFERRED EMBODIMENT

The following describes the embodiments of the present invention with reference to the accompanying drawings.

(Structure and Functional Operation of the Image Forming Section)

Figure 1:
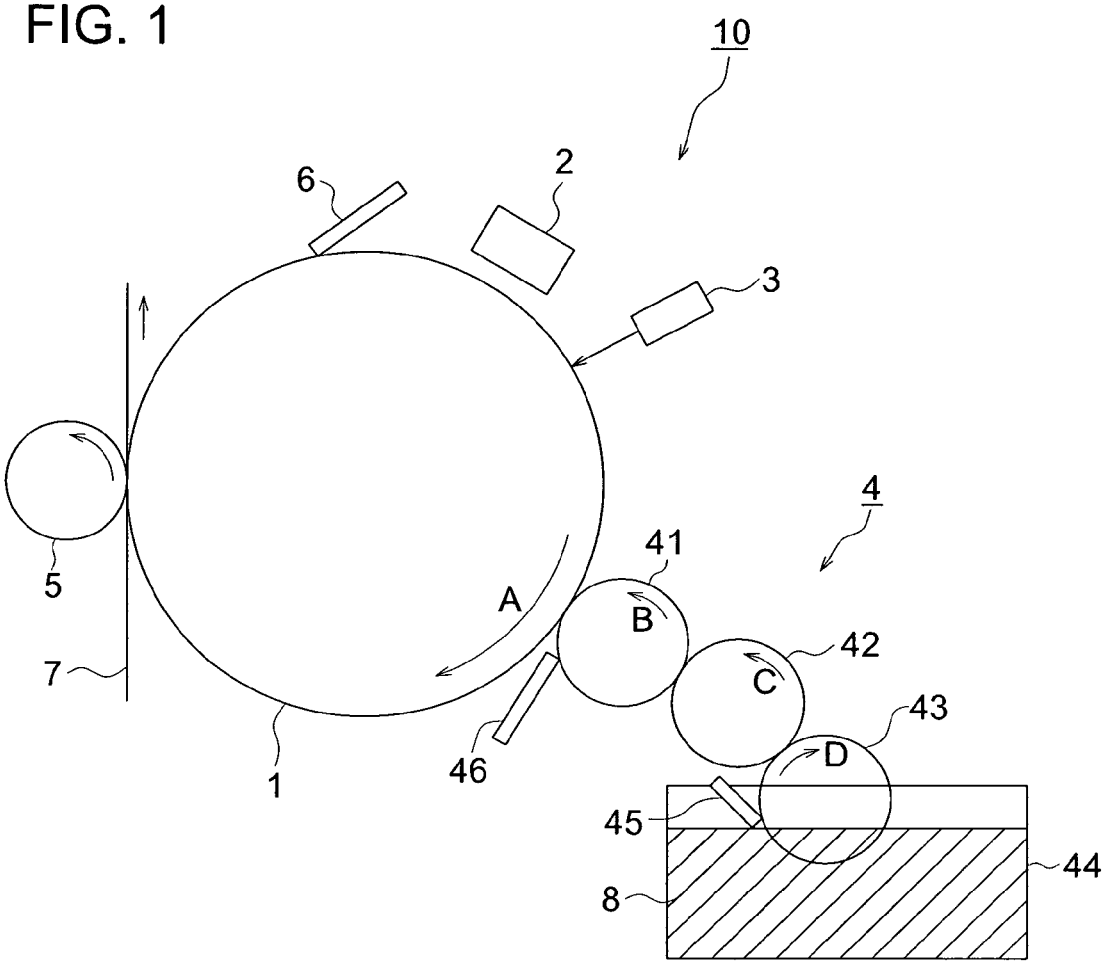
FIG. 1 is a cross sectional view representing the schematic structure of the image forming section 10 used in the image forming apparatus according to a first embodiment.

FIG. 1 is a cross sectional view representing an example of the schematic structure of the image forming section used in the wet type image forming apparatus according to the present embodiment.

In FIG. 1, reference numeral 1 denotes a photoreceptor drum, and works as an image carrier. The image forming section 10 includes a charging device 2 arranged around the photoreceptor drum 1 to uniformly charge the surface of the aforementioned photoreceptor drum 1; an exposure device 3 for applying LED or laser beam onto the charged photoreceptor drum 1 to form an electrostatic latent image; a liquid development device 4 for developing the electrostatic latent image using a liquid developer; a transfer device 5 for transferring the developed toner image to a transfer media 7; and a cleaning device 6 for removing the liquid developer remaining on the surface of the photoreceptor drum after transferring the toner image.

In some cases, an apparatus for coating the photoreceptor drum 1 with the liquid developer in advance, and an apparatus for recovering a part of the excess liquid developer from the photoreceptor drum 1 are mounted before and after the liquid development device 4 respectively. The transfer media 7 can be a recording material such as recording paper. Alternatively, an intermediate transfer belt or the like can be used as the transfer media 7 so that the image is finally transferred again onto the recording material.

The liquid development device 4 includes a development roller 41 carrying a thin layer of liquid developer on its surface to develop the electrostatic latent image on the photoreceptor drum 1 as an image carrier; a conveyance roller 42 in contact with the development roller 41 to transfer the liquid developer of controlled liquid volume onto the surface thereof; and a supply roller 43 in contact with this conveyance roller 42 to supply the liquid developer 8 in the developer container 44 onto the surface thereof.

In FIG. 1, only one liquid development device 4 is provided. However, two or more development devices can be mounted for color image formation. A color development method and presence or absence of intermediate transfer can be arbitrarily chosen, and any configuration and layout can be implemented in conformity to this setting.

The photoreceptor drum 1 rotates in the direction shown by arrow A in FIG. 1. The charging device 2 changes the surface of the rotating photoreceptor drum 1 to the level of a few hundred volts by corona discharge. An electrostatic latent image, whose surface potential is reduced to a level below about 100 volts by the laser beam emitted from the exposure device 3, is formed on the downstream side from the charging device 2 in the rotating direction of the photoreceptor drum.

A liquid development device 4 is arranged on the downstream side from the exposure device 3, and the electrostatic latent image formed on the photoreceptor drum 1 is developed by the liquid developer 8.

In the liquid development device 4, the liquid developer 8 comprised of an insulating solvent (hereinafter also referred to as "carrier solution") with toner particles dispersed therein is stored in the developer container (developer container) 44. The liquid developer 8 is supplied onto the surface of the conveyance roller 42 by the supply roller 43.

The conveyance roller 42 conveys a thin layer of the liquid developer 8 and transfers it to the development roller 41. A thin layer of liquid developer 8 is carried on the development roller 41. Further, due to the potential difference between the development roller 41 and the electrostatic latent image on the photoreceptor drum 1, the toner particles within a thin layer of the liquid developer 8 carried on the development roller 41 move to the electrostatic latent image on the photoreceptor drum 1, and the electrostatic latent image is thereby developed.

In the transfer device 5, the toner image developed on the photoreceptor drum 1 is transferred onto the transfer media 7 conveyed at the same speed as the peripheral speed of the photoreceptor drum 1, which transfer media 7 is supplied with a voltage or charged by the transfer device 5.

A cleaning device 6 for removing the remaining liquid developer 8 from the surface of the photoreceptor drum 1 is arranged on the downstream side from the transfer device 5. The remaining liquid developer 8 on the photoreceptor drum 1 is removed by this cleaning device 6.

The transfer media 7 to which the toner image has been transferred by the transfer device 5 is conveyed to the fixing apparatus (not illustrated) if it is a recording material, and is ejected after heat-fixing. If the transfer media 7 is an intermediate transfer media such as an intermediate transfer belt, the toner image is then transferred onto the recording material, and the recording material with the toner image transferred thereon is also conveyed to the fixing apparatus. It is ejected upon completion of the heat-fixing.

(Composition of the Developer)

The following describes the liquid developer 8 used for development. The liquid developer 8 is comprised of the carrier solution as a solvent with colored toner particles dispersed therein in high concentration. Additives such as a dispersant and electric charge regulating agent can be appropriately added to the liquid developer 8.

The solvent which is insulating and nonvolatile at the normal temperature is used as a carrier solution. The toner particles are mainly made up of resin as well as pigment and dye for coloring. The resin has a function of dispersing the pigment and dye uniformly therein and a binding function at the time of fixing an image on the recording material.

The volume average particle size of the toner is preferably in the range of 0.1 μm or more without exceeding 5 μm. If the average particle size of the toner is below 0.1 μm, the performance of the developer will be much reduced. If the average particle size is over 5 μm, the image quality will be reduced.

The percentage of the mass of toner particles with respect to the mass of the liquid developer is preferably in the range of 10 through 40%. If it is below 10%, toner particles tend to precipitate, and there will be a problem in chronological stability at the case of long-term storage. Further, to obtain a sufficient image concentration, a large quantity of developer needs to be supplied. This will require such a large amount of carrier solution to be attached to the paper that environmental problems may be caused by a large amount of vapor produced when the attached carrier solution is dried. If the percentage is over 40%, the viscosity of the liquid developer will be excessive, and the manufacturing and handling difficulties will arise.

(Structure and Operation of Development Apparatus)

Figure 2:
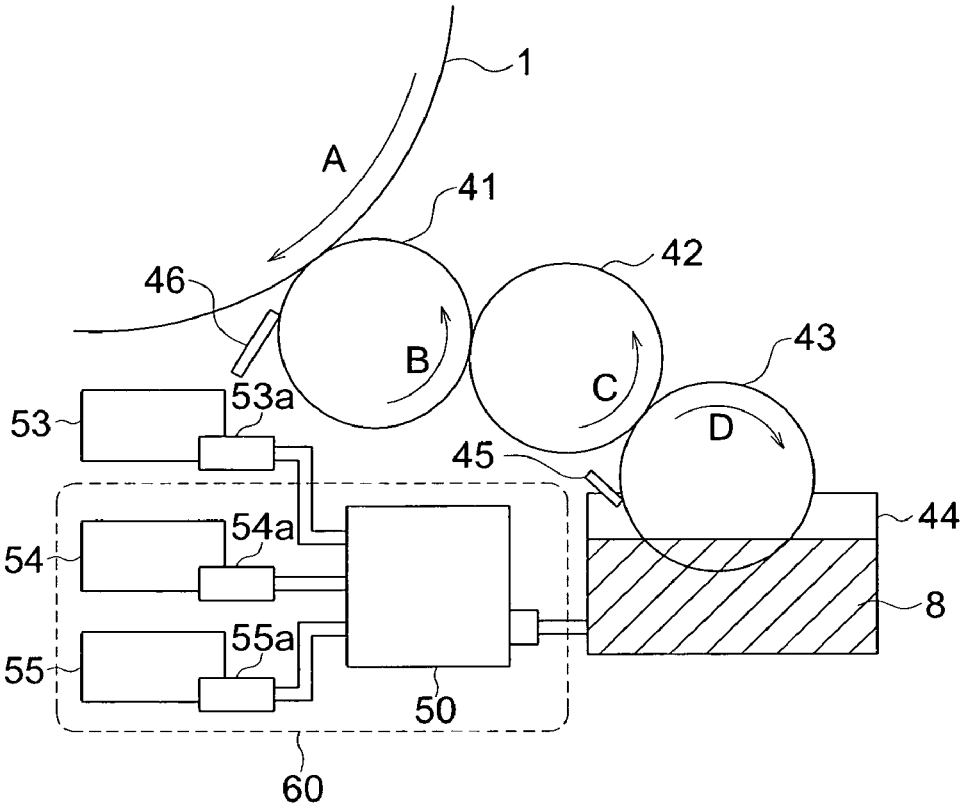
FIG. 2 is a layout diagram showing the schematic structure of the liquid development device 4 of FIG. 1.

FIG. 2 is a layout diagram showing the schematic structure of the liquid development device 4.

The developer container 44 contains the liquid developer 8.

The supply roller 43 is arranged to be immersed in the liquid developer 8 contained in the developer container 44. The roller rotates in the direction D shown by the arrow, and draws up liquid developer 8 from the developer container 44. The highly viscous liquid developer 8 is conveyed as it sticks to the surface of the supply roller 43 by its own adhesive force.

The regulating member 45 is arranged in contact with the supply roller 43 in the counter direction opposite to its rotating direction, as illustrated, and is used to regulate the amount of developer conveyed being attached to the surface of the supply roller 43. This arrangement removes the unwanted excess developer. Thus, a thin layer of developer is formed on the surface of the supply roller 43, and is fed toward the next conveyance roller 42.

A rubber roller is generally used as the conveyance roller 42. The conveyance roller 42 is arranged facing the supply roller 43, and rotates in the arrow-marked direction C in contact therewith. A thin layer of developer formed on the surface of the supply roller 43 by this nip section is transferred onto the surface of the conveyance roller 42, and is fed to the development roller 41.

A rubber roller of low hardness is used as the development roller 41. The development roller 41 is arranged facing the conveyance roller 42, and rotates in the arrow-marked direction B. A thin layer of developer conveyed to the surface of the conveyance roller 42 is scraped off by the development roller 41 through this nip section, and the developer is carried and conveyed on the surface of the development roller 41. Thus, the development roller 41 serves as a developer carrier.

In this case, the conveyance roller 42 forms a thin layer of developer and hands it over to the developer carrier. However, this function can be performed by the supply roller 43. To put it another way, it is also possible to make such arrangements that the developer is fed from the supply roller 43 directly to the development roller 41.

The development roller 41 rotates in contact with the photoreceptor drum 1 as the image carrier as well. Thus, the latent image on the photoreceptor drum 1 is developed by the thin layer of the developer having been fed to the nip section formed with the photoreceptor drum 1, in other words, a development area.

However, after the latent image of the photoreceptor drum 1 has been developed, a thin layer of developer still remains on the surface of the development roller 41. If the remaining developer is again fed to the development area, the next development operation may be adversely affected. The removing member 46 is a blade for cleaning and is used to remove this remaining developer.

(Structure for Recovery and Reuse of Developer)

FIG. 2 is a layout diagram showing the schematic structure to recover and reuse the remaining developer removed in the liquid development device 4.

As described above, the developer remaining on the development roller 41 is removed by the removing member 46. The recovered developer is put into a container to be discarded or reused. The present embodiment has a configuration which can reuse the recovered developer and does not need a container for developer to be discarded and effectively uses the developer.

The developer scraped off from the surface of the development roller 41 by the removing member 46 is once stored in a recovered developer container 53 as a recovered developer.

The recovered developer stored in the recovered developer container 53 is fed to the developer concentration adjusting apparatus 60 so that the concentration will be adjusted to a desired level for reuse. The recovered developer container 53 is provided with a developer supplying mechanism such as a recovered developer supplying mechanism 53*a*. This recovered developer supplying mechanism 53*a* is designed to feed the recovered developer to the developer concentration adjusting apparatus 60. It is possible to employ a commonly used pump whose operation can be controlled to change the supply speed.

The recovered developer, whose concentration has been adjusted to a desired level by the developer concentration adjusting apparatus 60, is supplied to the developer container 44 of the liquid development device 4 and is reused. It is also possible to make such arrangements that a supply container is provided to temporarily store the recovered developer having been adjusted to a desired level of concentration and to supply it from the supply container to the developer container 44.

<Structure of Developer Concentration Adjusting Apparatus>

Figure 3:
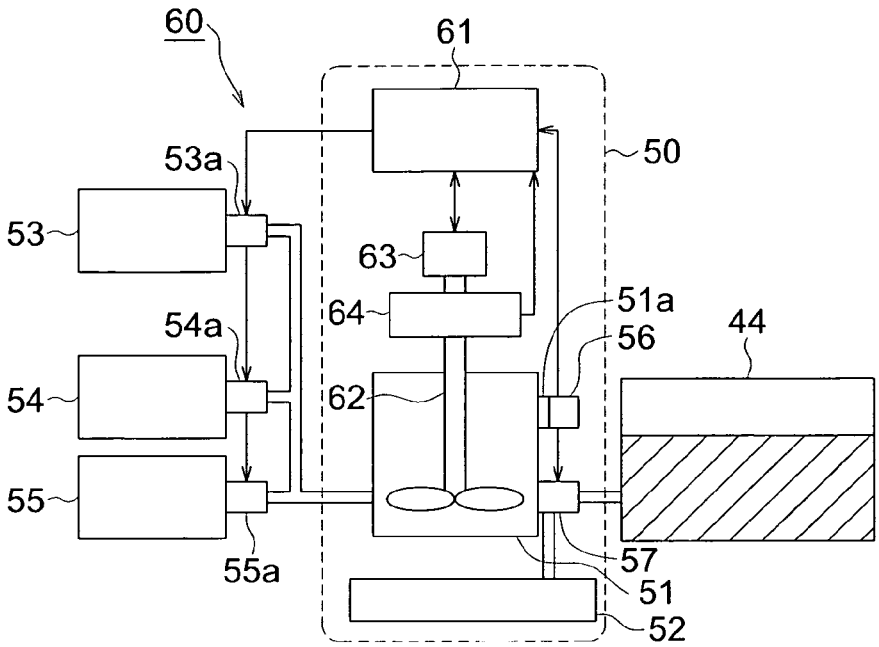
FIG. 3 is a layout diagram showing the schematic structure of the developer concentration adjusting apparatus 60 of FIG. 2.

FIG. 3 also shows the schematic structure of the developer concentration adjusting apparatus 60 shown in FIG. 2.

The developer concentration adjusting apparatus 60 includes a developer concentration measuring device 50, a first supply liquid container 54, a first liquid supplying mechanism 54*a*, second supply liquid container 55, and second liquid supplying mechanism 55*a*.

The liquid developer (hereinafter also referred to as "high-concentration liquid") of higher concentration than a desired level is stored in the first supply liquid container 54 as the first supply liquid, and is put into the developer concentration measuring device 50 by the first liquid supplying mechanism 54*a*. It is possible to employ a commonly used pump as the first liquid supplying mechanism 54*a* if its operation can be controlled to change the supply speed.

The liquid developer (including the case of carrier solution alone, hereinafter also referred to as "low-concentration liquid") of lower concentration than a desired level is stored in the second supply liquid container 55 as the second supply liquid. It is supplied to the developer concentration measuring device 50 by the second liquid supplying mechanism 55*a*. It is possible to employ a commonly used pump as the second liquid supplying mechanism 55*a* if its operation can be controlled to change the supply speed.

The recovered developer is fed to the developer concentration measuring device 50 as the liquid developer (hereinafter referred to as "concentration adjusting solution") whose concentration should be adjusted, from the recovered developer container 53 by the recovered developer supplying mechanism 53*a*.

The developer concentration measuring device 50 measures the concentration of the concentration adjusting solution (actually, a detection value detected in measuring the physical property value corresponding to the concentration). Based on the result of comparison with a desired concentration (a desired detection value), the aforementioned first supply liquid or the second supply liquid is supplied. To be more specific, if the detection value is lower than the desired concentration, high-concentration developer (the first supply liquid) is supplied. If the detection value is higher than the desired concentration, the low-concentration developer (the second supply liquid) is supplied.

In the developer concentration adjusting apparatus 60, the concentration is measured by the aforementioned developer concentration measuring device 50, and the supply liquid is supplied, until the concentration of the concentration adjusting solution reaches a desired level.

When the concentration of the concentration adjusting solution has reached the desired level, the concentration adjustment terminates. The concentration adjusting solution with its concentration having been adjusted is supplied from the developer concentration adjusting apparatus 60 to the developer container 44 of the liquid development device 4.

<Structure of Developer Concentration Measuring Device>

The developer concentration measuring device 50 includes a concentration adjusting container 51, discharged developer container 52, controller 61, stirring mechanism 62, drive device 63, and load detector 64.

The concentration adjusting container 51 stores the concentration adjusting solution for concentration adjustment. The stirring mechanism 62 is driven by the drive device 63 to stir the concentration adjusting solution in the concentration adjusting container 51. The stirring load is detected by the load detector 64, and the concentration is whereby measured.

Figure 4:
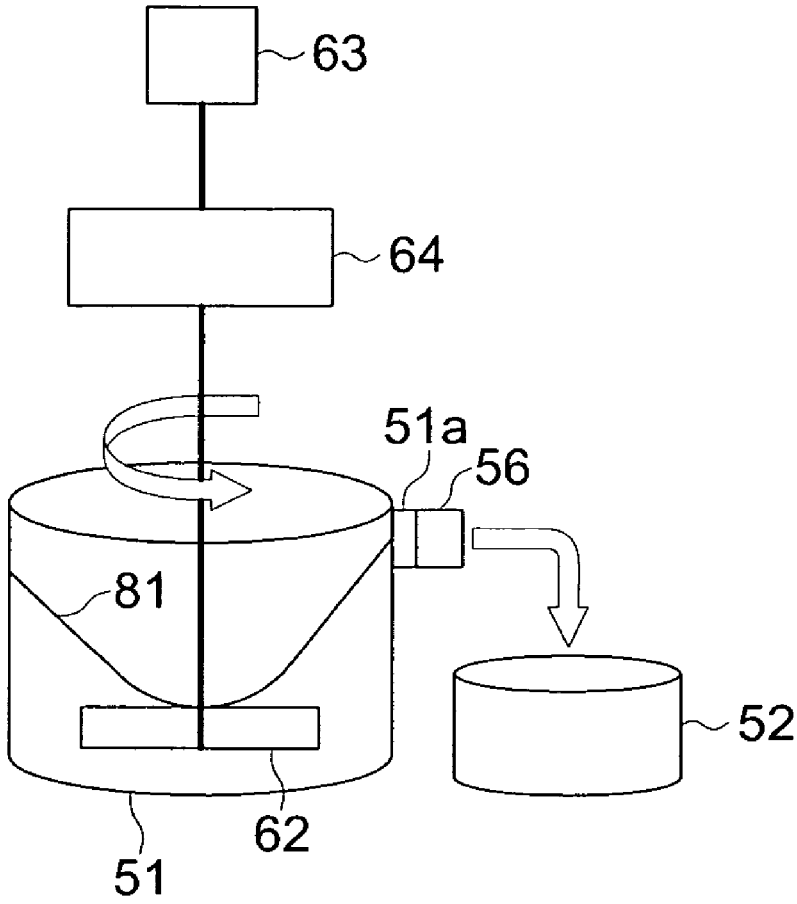
FIG. 4 is a schematic diagram representing the operation of the developer concentration measuring device 50 of FIG. 3.

FIG. 4 is an apparatus schematic diagram representing the operation of the developer concentration measuring section 50.

The concentration adjusting container 51 is a cylindrical vessel. The upper portion of the side wall is provided with an opening 51*a*. When there is an increase in the amount of the stored concentration adjusting solution with the solution level being higher than the opening, the excess solution overflows through the opening 51*a*, and the top surface of the concentration adjusting solution is thereby kept at a constant level. It should be noted that the top of the concentration adjusting container 51 can be fully open, and the concentration adjusting solution may overflow through the fully opened entire top end. Alternatively, a suction device may be used for suctioning the concentration adjusting solution stored in the concentration adjusting container 51 from above the concentration adjusting solution in order to keep the top surface of the concentration adjusting solution at a constant level. For example, the upper portion of the concentration adjusting solution is suctioned by a pump through a pipe connected to the pump, whereby the top surface of the concentration adjusting solution can be kept at a level of a suction opening of the pipe. The concentration adjusting container 51 is provided with a developer filling mechanism 57 (FIG. 3). This developer filling mechanism 57 is used to feed a concentration-adjusted developer to the developer container 44. A general pump whose operation can be controlled can be employed as the developer filling mechanism 57. Further, this developer filling mechanism 57 also has a function of a developer discharging mechanism which discharges the concentration adjusting solution in the concentration adjusting container 51 to the discharged developer container 52.

The concentration adjusting container 51 is provided with an OF detector such as a sensor OF (overflow) detecting sensor for detecting a presence or absence of overflow through the opening 51*a*. When there is an overflow, the OF value as an output from the OF detecting sensor 56 is ON. When there is no overflow, the OF value is OFF.

The discharged developer container 52 receives and stores the overflowing concentration adjusting solution. The concentration adjusting solution stored in the discharged developer container 52 may be discharged, but it is preferably recovered as a new concentration adjusting solution for effective reuse at the time of the next concentration adjustment. This discharged developer container 52 is arranged immediately below the concentration adjusting container 51 (FIG. 3). FIG. 4 is a schematic diagram representing the function of the opening 51*a* for easier understanding.

The stirring mechanism 62 is a stirring blade, for example, and is installed inside the concentration adjusting container 51. It is driven by the drive device 63 to stir the concentration adjusting solution stored therein. The drive device 63 is a motor, for example, and is used to drive the stirring blade as a stirring mechanism 62 under predetermined stirring conditions.

The load detector 64 detects the stirring load when the stirring mechanism 62 is driven by the drive device 63. It obtains a detection value corresponding to the viscosity as the physical property value. The viscosity depends on the concentration. To be more specific, the load detector 64 serves as a physical property detector.

Various types of devices can be used as the load detector 64. In the present embodiment, a dynamic torque meter for detecting the torque with respect to the rotation of the stirring blade through the motor 63 and stirring blade 62 is used as the load detector 64. The dynamic torque meter detects the torque required to drive the stirring blade at a predetermined speed, and sends the output value corresponding to this torque to the controller 61. Instead of this dynamic torque meter, an ammeter can be used as the load detector. The ammeter measures the current to drive the motor 63 at a predetermined speed, and sends the result of measurement to the controller 61.

The controller 61 controls the operation of the components, and acquires the concentration of the concentration adjusting solution or the detection value corresponding to the concentration. Further, based on the comparison with a desired concentration (or a desired detection value corresponding thereto), the controller 61 controls the operation of supplying such a liquid as the first supply liquid for concentration adjustment or the second supply liquid. Further, the controller 61 also controls the operations of supplying and discharging the concentration adjusting solution and supplying the concentration-adjusted developer. The controller 61 may be made up of a microcomputer and memory.

The aforementioned developer concentration measuring device 50 is configured to calculate concentration by detecting the stirring load when the developer for concentration adjustment is stirred. This is based on the fact that the viscosity differs according to the concentration of the developer supplied for measurement, thus the stirring load for stirring differs.

As described above, the liquid developer is comprised of the carrier solution with toner dispersed therein. The liquid developer concentration is expressed by concentration of the toner in the developer.

In the present embodiment, the concentration is obtained by measuring the viscosity. The viscosity also changes as the concentration of the developer changes. There is a big change of viscosity particularly in the area of high concentration. This arrangement ensures a sufficient sensitivity of measurement.

Further, if there is a change in the viscosity of the developer, there is a change in the stirring load required for stirring. This fact can be used to measure the viscosity from the stirring load, further to measure the concentration.

To obtain the viscosity from the stirring load, the conditions at the time of stirring must be kept constant. To be more specific, it is necessary to control the volume of developer.

In the present embodiment, to ensure that the level of the highest liquid surface of the developer to be measured is kept constant, the concentration adjusting container 51 is provided with the opening 51*a* so as to permit the liquid to overflow. Actually, when the liquid is stirred, the liquid surface is formed in a funnel shape. Depending on the viscosity, there is a difference in the volume of the residual liquid at the time of overflow.

As can been seen from FIG. 4, the liquid developer is moved outward by the centrifugal force by the rotation of the stirring blade, and the liquid level 81 is formed in a big funnel shape.

Thus, the opening 51*a* restricts the upper limit of the liquid level on the outermost position. This causes the volume of liquid to be changed according to the viscosity of the developer.

The present embodiment (FIG. 4) is not based on the concept that the volume of liquid at the time of stirring is controlled at a constant volume at all times without depending on the viscosity. Instead, the present embodiment assumes that the volume of liquid at the time of stirring is constant for the developer of the same viscosity. In the present embodiment (FIG. 4), the liquid surface of the developer of the same viscosity is regulated by the opening 51*a*, whereby the liquid surface of the same funnel shape is realized, and the same volume of liquid can be hence achieved.

It goes without saying that a difference in the viscosity of the developer leads to a difference in the volume of liquid. A predetermined liquid surface, in other words, a predetermined volume of liquid can be achieved in response to each viscosity, and the stirring load thus corresponds to the volume of liquid and the viscosity.

Liquid volume control does not need to be performed every time the viscosity is measured. The required control is automatically provided by the opening 51*a*. Even if the developer of different concentration is supplied during measurement, the liquid volume is automatically controlled in response to a change in viscosity.

As described above, when the stirring load is used as the detection value to control concentration, the problem that the detection value also depends on the volume of liquid can be solved by overflowing. In the meantime, the detection value has another meaning even in the phase of supplying the concentration adjusting solution, in other words, in the phase wherein overflowing has not yet occurred. To be more specific, there is only a small volume of liquid at this point of time, and therefore, the detection value appears as if the concentration were lower, as compared with the detection value at the time when the liquid of the same concentration is overflowing.

To be more specific, if the detection value is higher than a desired value despite an absence of overflow, the concentration is higher than a desired level. Further, if the detection value is lower than a desired level, the concentration may be lower than a desired level, depending on how low it is.

In the present embodiment, for concentration adjustment, load detection and concentration adjustment operation are started prior to the occurrence of overflow, and the approximate concentration of the concentration adjusting solution is estimated from the detection value at that point of time and the information on a presence or absence of overload. This estimation is reflected to the controls of supplying liquid and a supply speed of liquid. This arrangement can reduce the time required for the concentration adjustment while restricting the amount of supply liquid used for the adjustment.

Although the measurement of concentration by viscosity has been described above, the toner concentration can be measured by the weight of the liquid developer, since the volume depends on the viscosity.

Typically, the density of the carrier solution is about 0.85, the density of the developer having a concentration of 25% by mass is about 0.95, and the density of the high density developer (concentration of 35% by mass) is about 0.99. Therefore, assuming that a 1-liter vessel is provided with an opening at the position where an overflow occurs with residual developer of 800 g for the developer having a concentration of 25% by mass, if the carrier solution is accommodated, the weight of the solution is approximately 725 g, if the developer with a concentration of 35% by mass is accommodated, the weight of the developer is approximately 835 g. This method has a feature that the weight of the mass changes greater than the density because the lower the density is, the less the liquid remains.

Further, the funnel shaped liquid level at the time of stirring also depends on toner concentration. Thus, the toner concentration can be adjusted by measuring the height of the liquid level other than the circumferential edge and comparing the measured level with the target value.

Further, the concentration can be adjusted by using a pressure sensor to measure the pressure applied to the surface of the stirring blade. Measurement of the pressure is equivalent to measurement of the motor drive torque, and is equivalent to measurement of the viscosity.

Above-mentioned appropriate physical property values can be used. The following describes the example of controlling the toner concentration using the viscosity (stirring load at the time of stirring).

(Concentration Control Operation of Developer Concentration Adjusting Apparatus)

Figure 5:
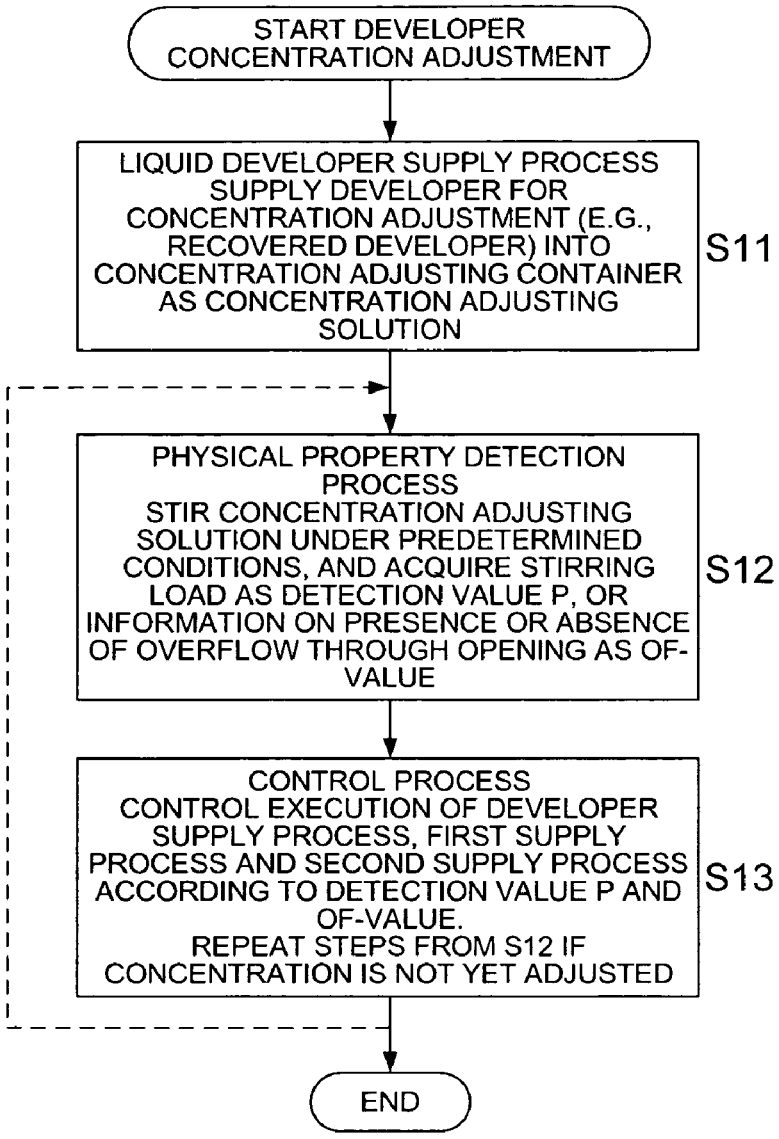
FIG. 5 is a flowchart showing processes for controlling the concentration in the developer concentration adjusting apparatus 60.

FIG. 5 is a flowchart showing each process for adjusting the concentration in the developer concentration adjusting apparatus. Referring to FIG. 5, the following describes the concentration adjustment operation of the developer concentration adjusting apparatus.

When the developer concentration adjustment has started, the controller 61 drives the recovered developer supplying mechanism 53*a* in Step S11 (step of supplying liquid developer) so that the development whose concentration is to be adjusted (recovered developer) will be stored in the concentration adjusting container 51 as the concentration adjusting solution.

In Step S12 (step of detecting a physical property), the controller 61 drives the stirring mechanism 62 using the drive device 63 (step of stirring the liquid developer). To put it more specifically, the stirring blade rotates at a predetermined speed to stir the concentration adjusting solution. The speed of the drive device 63 can be controlled in the conventional method. This Step S12 starts between the time when the concentration adjusting solution starts to be supplied to the concentration adjusting container 51 and the time when overflow occurs, and then, the stirring is continuously performed, and the stirring load thereof is continuously detected.

When the concentration adjusting solution has accumulated to some extent, the liquid surface thereof becomes a funnel shape. In the final phase, the excess developer overflows through the opening 51*a* to enter the discharged developer container 52. During this period of time, in response to the change in the volume of the concentration adjusting solution, the stirring load is acquired as the detection value by the load detector 64. Further, the on/off status of the overflow is also detected by the OF detecting sensor 56 (step of detecting a presence or absence of overflow).

In this case, it is important that the detection value should be obtained before the concentration adjusting solution overflows. Even before the overflow occurs, the following step (concentration adjustment control process) can be performed based on the detection value.

Detection of stirring load for detecting the stirring load by using a dynamic torque meter is conducted under the control of the controller 61 at an appropriate timing.

In Step S13 (control step), the controller 61 controls the first liquid supplying mechanism 54*a* and the second liquid supplying mechanism 55*a* according to the detected stirring load (the detection value) and OF value. Thus, the step of supplying the first supply liquid and the step of supplying the second supply liquid are carried out, and the concentration is adjusted.

In Step S13, although only the supply of supply liquid may be controlled, the supply of the recovered liquid developer is preferably controlled. To be more specific, because the control for the detection of the physical property and the concentration adjustment is performed along with the supply of the recovered liquid developer, the controls including the supply speed of liquid are started at the time of starting the supply of the concentration adjusting solution. This arrangement ensures concentration adjustment in a shorter period of time with efficient consumption of the supply liquid.

Accordingly, in the following detailed description of the control process, it is assumed that the control of the supply of all the liquids, including the control of the supply of the recovered developer, is conducted.

Control in the step of supplying liquid is performed comparing the detection value with the preset reference levels. The reference levels include a target detection value representing a desired concentration, a target detection value range showing the allowable concentration range, a supply level and stop level for determining whether the supply liquid is supplied or stopped, and the forced discharge level for evaluating the improvement of efficiency by forced discharge in the concentration adjustment (FIGS. 6*a*, 6*b*, 7*a* and 7*b*). As will be described later, the area of each detection value of each mode indicating each supply speed is also set in advance.

Further, when a Table of the correspondence between the detection value (stirring load) and the predetermined reference level for controlling each step is stored in the controller 61 in advance after evaluating the correspondence, execution of each step can be controlled merely by referring to this Table.

Step S12 and S13 are repeatedly carried out on a continual basis, and in response to the frequently detected detection value, the liquid supply and the supply speed are controlled (step of controlling a supply speed of the first supply liquid or the second supply liquid), whereby concentration is adjusted in a short period of time using a smaller volume of the supply liquids. When entry within a desired concentration range has been confirmed in Step S13, the system exits from the repeated performances of Steps S12 and S13, and concentration adjustment is terminated.

(Concentration Adjustment Control Step)

The following describes the outline of the operation performed in the control process of Step S13 shown in FIG. 5, namely, the outline of the control performed according to the detection value and the OF value.

In the recovered liquid developer supply step, the first supply step, and second supply step, each liquid supply speed is variable. In this case, three liquid supply modes are provided in each step; a high-speed supply mode for liquid supply at a high speed, a standard supply mode for liquid supply at a standard intermediate speed, and a low-speed supply mode for liquid supply at a low speed.

These liquid supply modes are selected basically in response to the detection value. To be more specific, the high-speed mode is selected when the difference between the detection value and the target detection value is greater, whereas the low-speed mode is selected when the difference between the detection value and target detection value is smaller. Further, the liquid supply mode can be switched by the OF value as well.

Further, the liquid supply itself in each step can also be controlled according to the detection value and the OF value.

<Selection of Liquid Supply>

Figure 6A:
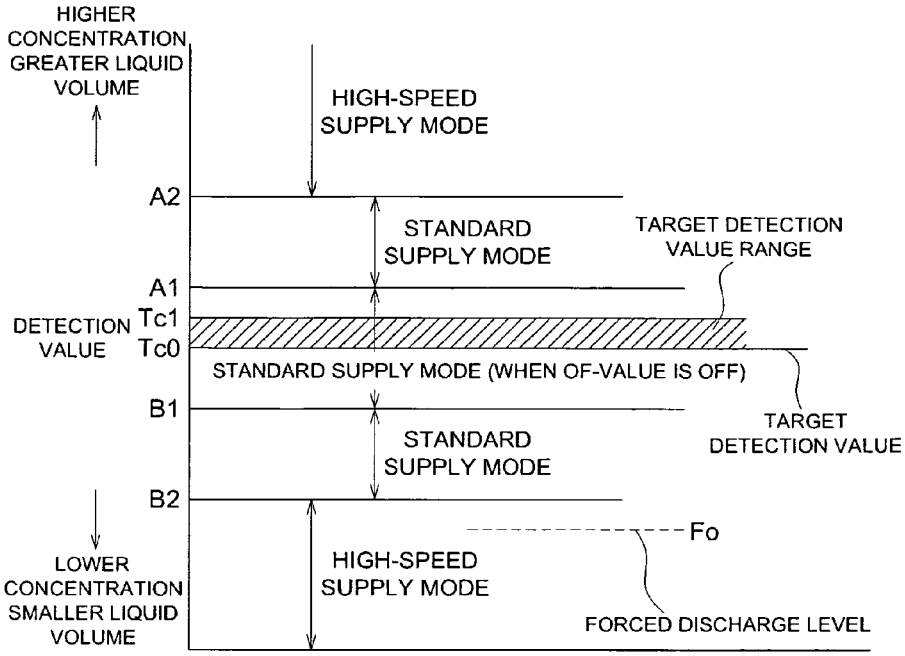
FIGS. 6*a* and 6*b* are the diagrams showing the relationship between the detection value and the selected liquid supply mode corresponding to the detected value in the concentration control process.
Figure 6B:
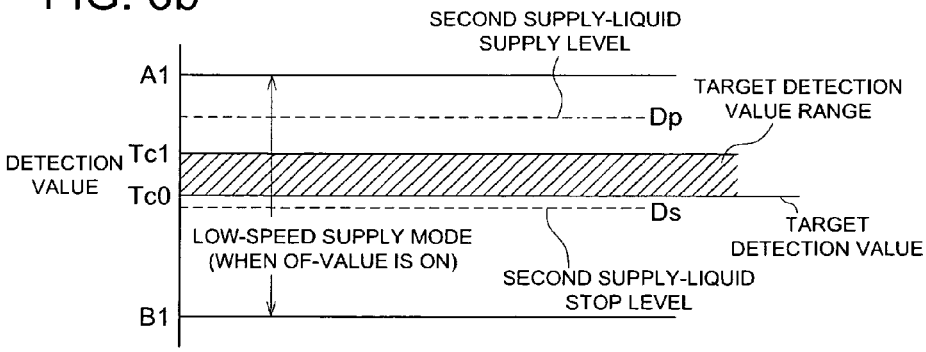

FIGS. 6*a* and 6*b* show the relationship between the detection value and selection of each mode. FIG. 6*a* shows the case wherein the OF value is off, while FIG. 6*b* shows the case wherein the OF value is on. It should be noted that FIG. 6*b* shows the case wherein the detection value is in the range of A1 to B1. If the detection value is in other ranges, the relation ship is from the same as the illustration of FIG. 6*a*.

(a1) When the detection value is small (B2 or less in FIG. 6*a*), the volume of liquid in the concentration adjusting container 51 is estimated to be still smaller, and high-speed supply mode is selected to increase the volume of liquid quickly.

(a2) When the detection value has been increased (between B2 and B1), the liquid volume is estimated to have increased to some extent, and the standard supply mode is selected to reduce the supply speed slightly.

(a3) If the detection value has come close to the target detection value (Tc0) (between B1 and A1), the following step is taken:

<1> When the OF value is OFF, the liquid volume is increased maintaining the standard supply mode.

<2> When the OF value is ON, it means that the detection value indicates the concentration, and the low speed mode is selected to enter the final phase of concentration adjustment.

It is preferable that the detection value does not exceed the target detection value (Tc0) to enter the area of the standard supply mode (between A1 and A2) or the area (A2 or higher) of the high-speed supply mode. In the present embodiment, the control is performed such that the control starts from where the concentration adjusting container is empty (the minimum detection value), and the detection value does not exceed the area of low-speed supply mode (between B1 and A1) because of overshooting.

<Control of Liquid Supply Step>

Figure 7A:
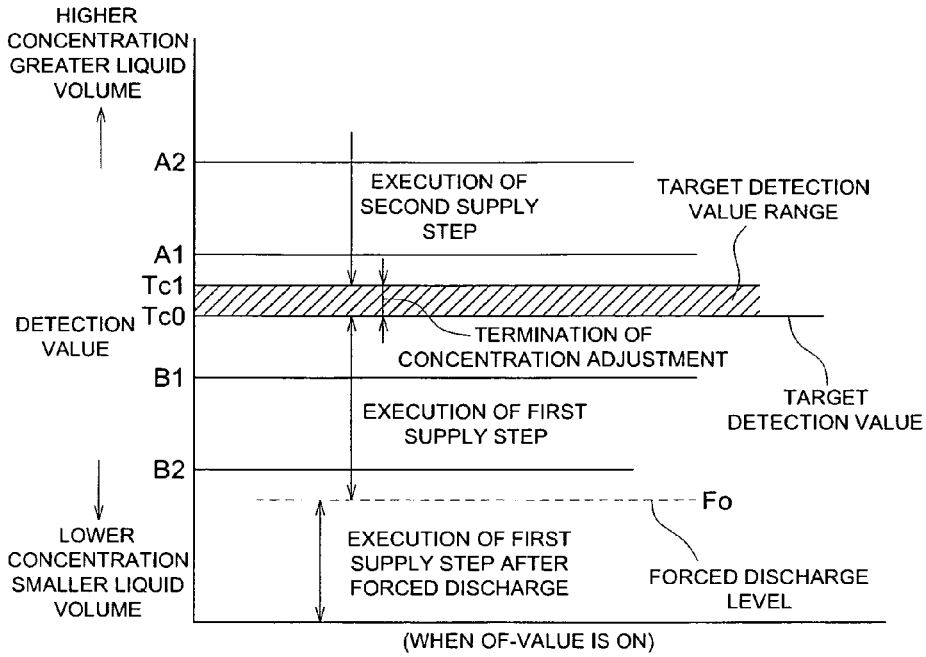
FIGS. 7*a* and 7*b* are the diagrams showing the relationship between the detection value and the reference level for the control of liquid supply in the concentration control process.
Figure 7B:
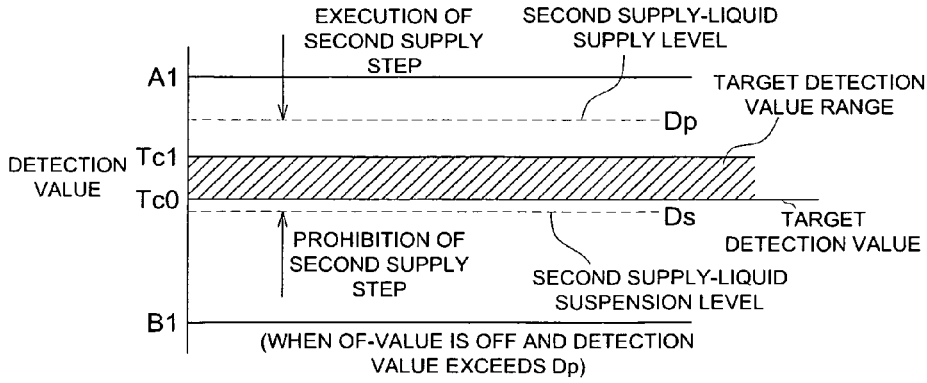

FIGS. 7*a* and 7*b* show the relationship between the detection value and the reference level for liquid supply. Referring to FIGS. 7*a* and 7*b*, the following describes the control of liquid supply according to the reference level of the detection value. FIG. 7*a* shows the case wherein the OF value is ON, and FIG. 7*b* shows the case wherein the OF value is OFF (the following b5).

(b1) When the detection value is below the forced discharge level Fo, and the OF value is ON, the concentration adjusting solution has a very low concentration. If the first supply step is kept executed to supply high-concentration liquid, excessive volume of liquid will be wasted, and too much time will be needed. Therefore, the liquid supply is once suspended and a predetermined volume of the concentration adjusting solution is force-discharged into the discharged developer container 52. After that, the first supply step is carried out.

(b2) When the detection value is below the target detection value range (between Tc0 and Tc1 in this case) and above the forced discharge level Fo, and the OF value is ON, the concentration adjusting solution has a low concentration. Thus, the first supply process is executed to supply high-concentration liquid.

(b3) When the detection value is within the target detection value range (between Tc0 and Tc1) and the OF value is ON, the concentration of the concentration adjusting solution is highly likely to be within the desired concentration range. Thus, all the liquid supplies are stopped, and a concentration adjustment termination operation starts, in which operation stirring operation is performed for a predetermined period of time, and if the detection value has deviated from the target detection value range during that stirring, a liquid supply operation is executed for a fine adjustment.

(b4) When the detection value exceeds the target detection value range (between Tc0 and Tc1), and the OF value is ON, the concentration adjusting solution has a high concentration. Thus, the second supply process is executed and the liquid of low concentration is supplied.

(b5) If the OF value remains OFF and the detection value is above the target detection value range (between Tc0 and Tc1), and:

<c1> if the detection level is above the second supply liquid supply level Dp, the concentration adjusting solution has a high concentration, and therefore, the second supply process is executed, whereby a low-concentration liquid is supplied; and <2> and after that, if the level has been reduced below the second supply liquid stop level Ds thereafter, the concentration of the concentration adjusting solution may be reduced, and therefore, the second supply process is stopped to terminate the supply of a low-concentration liquid.

<Setting Each Reference Level>

FIGS. 6*a* and 6*b*, and FIGS. 7*a* and 7*b* show the outlines of the reference levels for selecting each supply liquid and the areas for discriminating each supply mode. Referring to the drawings, the following describes the examples of settings of each reference level used for controlling each step of supplying liquid and settings of the areas for discriminating each mode.

The target detection value representing a desired concentration denotes the detection value when the concentration of the concentration adjusting solution is at the desired concentration. The target detection value has only to be set at an appropriate value in conformity to the image forming apparatus. Typically, a desired concentration is about 25%, and the target value is set at the value corresponding thereto.

The target detection value range (between Tc0 and Tc1) representing the allowable concentration range is generally in the range of +0.5% to −0% of the target detection value in terms of concentration.

The second supply liquid supply level Dp and stop level Ds for judging the supply of the second supply liquid are set with the upper and lower limits of the target detection range (Tc0 and Tc1) sandwiched therebetween, and are preferably set within the detection value range (between B1 and A1) corresponding to the low-speed supply mode. Specifically, the values are set in the range of +5% to −5% of the target value, particularly in the range of +1% and −1% in terms of concentration.

The concentration of about 50% through 80% with respect to the concentration of target detection value is appropriate for the forced discharge level Fo for judging improvement of the efficiency of concentration adjustment by forced ejection. Further, it is preferably set within the detection value range equivalent to the high-speed supply mode.

Regarding the detection value area corresponding to each liquid supply mode, the following settings are preferable in terms of concentration: the range of about +5% through −5% of the target detection level for the low-speed supply mode; the range of about +15% through −15% of the target detection level except for the area of the low-speed supply mode for the standard supply mode; and the outside of above areas for the high-speed supply mode.

The liquid supply speed of 10 through 200 ml/min. is preferable in the low-speed supply mode, the speed of 20 through 500 ml/min. is preferable in the standard supply mode, and the speed of 30 through 1000 ml/min. is preferable in the high-speed supply mode. The speeds can be set appropriately in response to the dimensions of the concentration adjusting container.

These settings depend on the apparatus conditions, and the optimum settings are different according to different apparatuses. These settings should be appropriately set depending on conditions.

(An Example of the Status of the Control Step)

Figure 8:
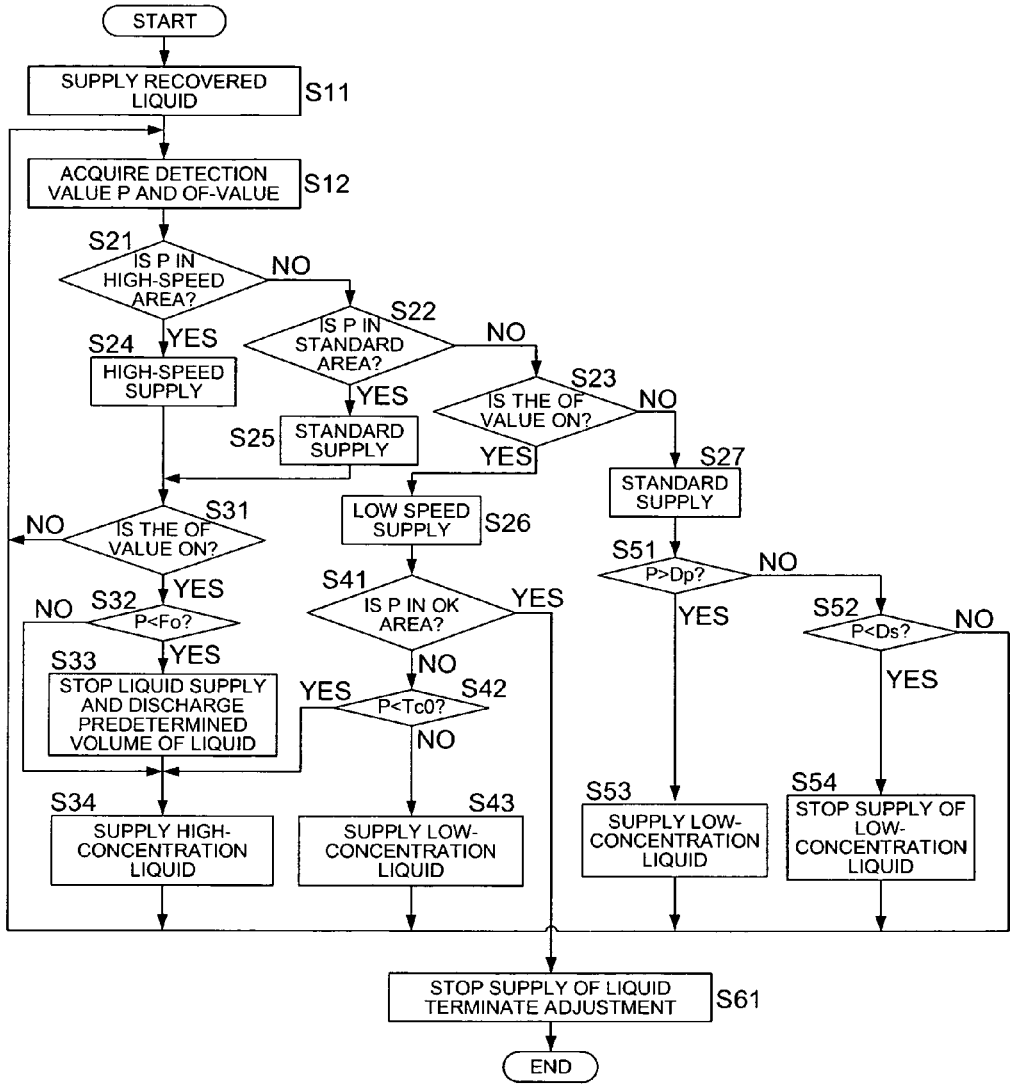
FIG. 8 is a flow chart showing the details of the flow in the concentration control process.

FIG. 8 is a flow chart showing the procedure of concentration adjustment by the developer concentration adjusting apparatus 60. FIG. 8 shows the Step S13 of FIG. 5, namely, the detailed flow of the control step, and shows the flow of the process in which the aforementioned liquid supply steps and selection of liquid supply speed are executed.

Figure 9:
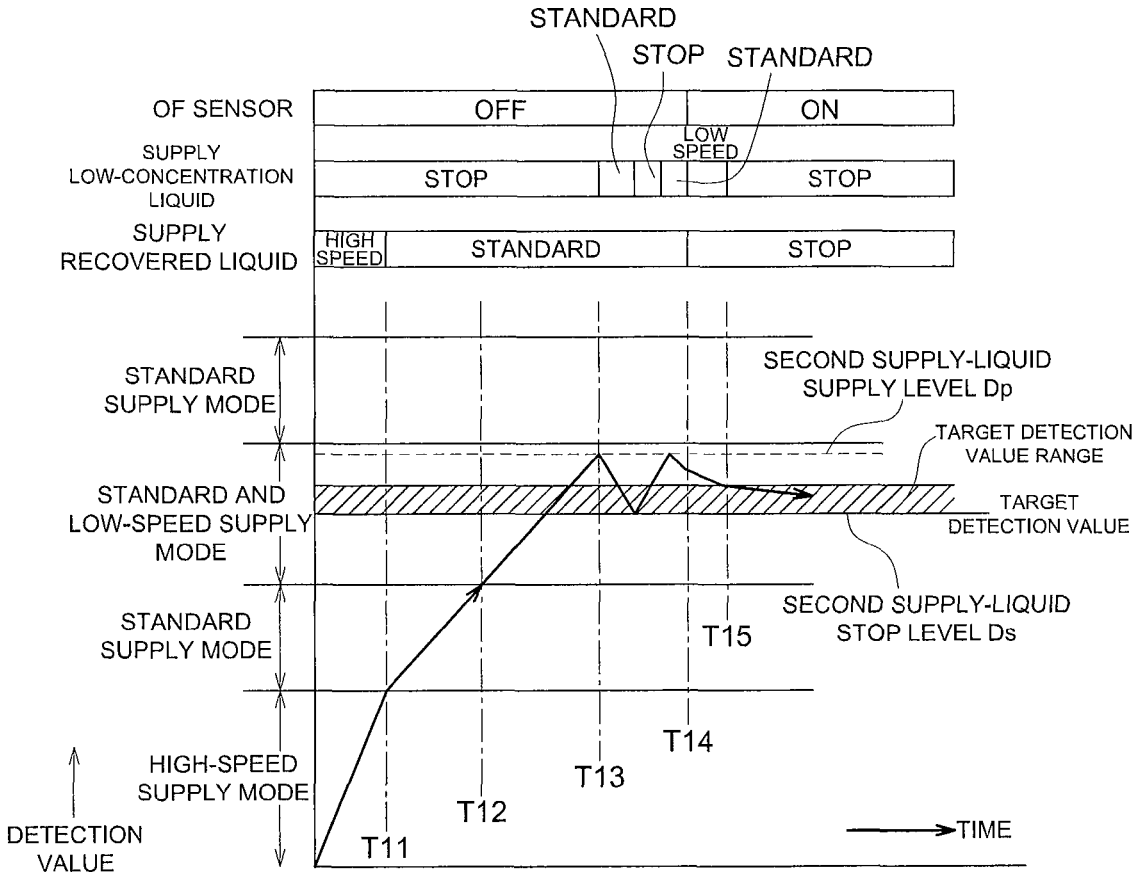
FIG. 9 is a diagram showing the example 1 of a control process, where the developer of higher concentration than a desired level is supplied.
Figure 10:
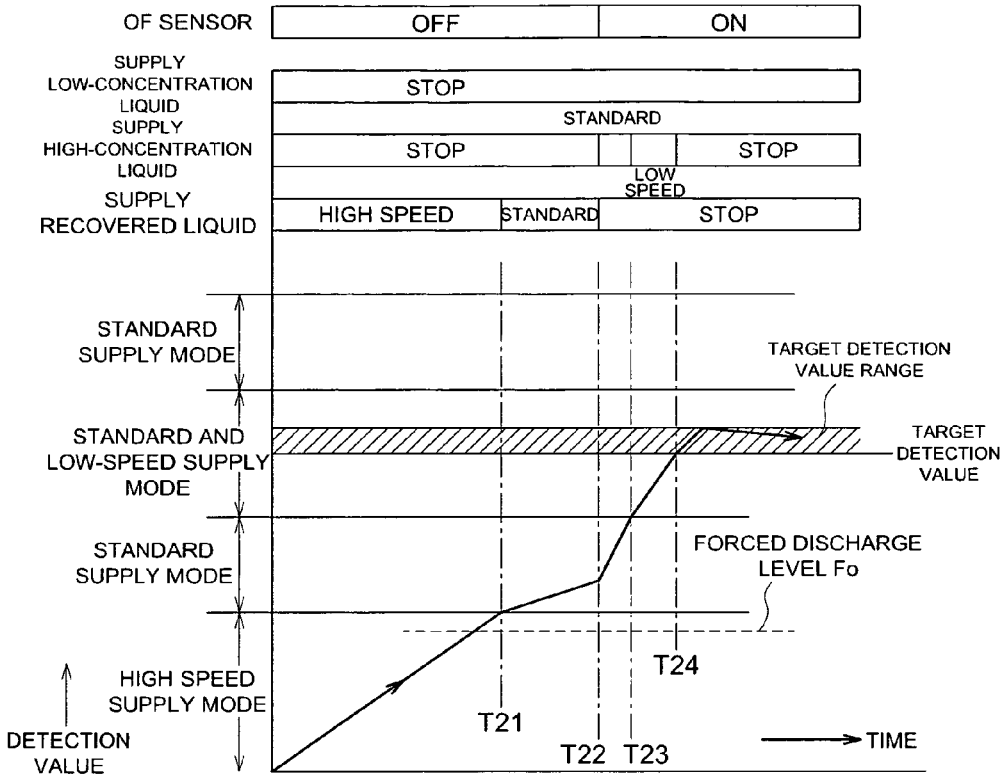
FIG. 10 is a diagram showing the example 2 of a control process, where the developer of lower concentration than a desired level is supplied.
Figure 11:
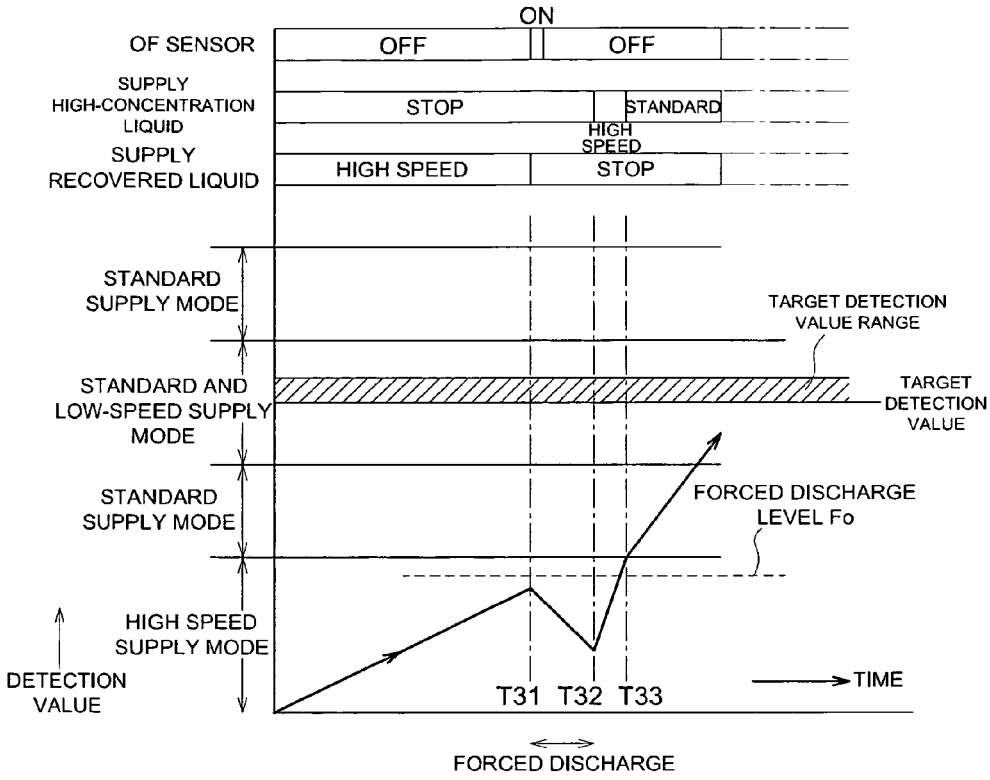
FIG. 11 is a diagram showing the example 3 of a control process, where the developer of still lower concentration than the desired level is supplied.

Further, FIG. 9 through FIG. 11 show the examples of processing of the concentration adjustment by the concentration controlling apparatus 60 by using the temporal change in the detection value and operation of the steps for the three cases of the concentration of the recovered developer (hereinafter referred to as "recovered liquid") being at a high concentration, low concentration, and still lower concentration.

Referring to FIG. 8, the following describes the flow of control in the concentration adjustment for each of the examples of FIG. 9 through FIG. 11.

<Processing Example 1: Recovered Liquid of High Concentration>

FIG. 9 is a diagram showing the example 1 of the control process wherein the developer supplied as the concentration adjusting solution has a concentration higher than the desired concentration.

Upon start of supply of the recovered liquid as the concentration adjusting solution (Step S11 of FIG. 8), the detection value P and the OF value are obtained in Step S12.

The detection value P is still small (Step S21: YES) at the time of start, so that the recovered liquid is supplied in the high-speed supply mode (Step S24). Because the liquid volume is small and the OF value is OFF (Step S31: NO), the process goes back to Step S12, and the aforementioned steps are repeated.

When the time is T11, the detection value P is larger (Step S21: NO) (Step S22: YES), and the recovered liquid supply shifts to the standard supply mode (Step S25). The liquid volume is still small and the OF value is OFF (Step S31: NO), and therefore, the process goes back to the Step S12, and the aforementioned steps are repeated.

When the time is T12, the detection value P is still larger (Step S22: NO). Since the OF value is still OFF (Step S23: NO), the standard supply mode continues (Step S27). The system goes back to the Step S12 after going through the (Step S51: NO) and (Step S52: YES or NO), and the aforementioned steps are repeated.

When the time is T13, the OF value is still OFF. However, the detection value P reaches the second supply liquid supply level Dp (Step S51: YES), and supply of low-concentration liquid (the second supply liquid) starts (Step S53). Then, the detection value P starts to decrease. The system goes back to the Step S12, and these steps are repeated. In this case, while the low-concentration liquid is supplied, the supply of recovered liquid can be suspended or the speed of supply can be reduced.

In due course, the detection value P reaches the second supply liquid stop level Ds (Step S51: NO) (Step S52: YES). Then the supply of the low-concentration liquid (the second supply liquid) is stopped (Step S54), and the detection value P starts to increase again.

When the time is T14, after the increase and decrease of the detection value P are repeated, the concentration adjusting solution starts to overflow, and the OF value becomes ON (Step S23: YES). The low-concentration liquid supply is changed into the low-speed supply mode (Step S26). Since the detection value P has not yet reached the target detection value range (Step S41: NO) (Step S42: NO), the supply of the recovered liquid is stopped, and supply of the low-concentration liquid (the second supply liquid) still continues (Step S43).

When the time is T15, the detection value P falls within the target detection value range (Step S41: YES), and the supply of low-concentration liquid (the second supply liquid) also is stopped. The process of the concentration adjustment enters the phase of termination (Step S61). To be more specific, the stirring continues for a predetermined period of time to see whether or not the detection value P is stabilized within the target detection value range.

This concludes the explanation of the example 1 of the control process when the developer supplied as the concentration adjusting solution has a concentration higher than the desired concentration level.

<Processing Example 2: Recovered Liquid of Low-Concentration>

FIG. 10 shows the example 2 of the control process wherein the processing example 2 of the control process when the developer supplied as the concentration adjusting solution has a concentration lower than the desired concentration.

Immediately after the start of supply of the recovered liquid as the concentration adjusting solution (Step S11 of FIG. 8), the detection value P and the OF value are acquired in Step S12.

The detection value P is still small (Step S21: YES) at the time of start, so that the recovered liquid is supplied in the high-speed supply mode (Step S24). Because the liquid volume is small and the OF value is off (Step S31: NO), the process goes back to Step S12, and the aforementioned steps are repeated.

When the time is T21, the detection value P is larger (Step S21: NO) (Step S22: YES), and the recovered liquid supply shifts to the standard supply mode (Step S25). The speed of increase in the detection value P is slightly reduced. The liquid volume is still small and the OF value is OFF (Step S31: NO), and therefore, the process goes back to the Step S12, and the aforementioned steps are repeated.

Since the supplied liquid has a low concentration, the speed of increase in the detection value P is slow. When the time is T22, the liquid overflows before the detection value P is increase very much, and the OF value is turned ON (Step S31: YES).

However, when the detection value P is equal to or greater than the forced discharge level Fo (Step S32: NO), the supply of the high-concentration liquid (the first supply liquid) starts (Step S34). The concentration adjusting solution still overflows, and the supply of the recovered liquid is preferably stopped. Since only the high-concentration liquid is supplied, the detection value P increases a little more quickly.

When the time is T23, the detection value P is still larger (Step S22: NO). Since the OF value is still ON (Step S23: YES), the liquid supply shifts to the low-speed supply mode (Step S26).

When the time is T24, the detection value P reaches the target detection value range (Step S41: YES), and the supply of the high-concentration liquid (the first supply liquid) is stopped, and the process of the concentration adjustment enters the phase of termination (Step S61). To be more specific, stirring continues for a predetermined period of time to see whether or not the detection value P is stabilized within the target detection value range.

This concludes the explanation of the example 2 of the control process when the developer supplied as the concentration adjusting solution has a concentration lower than the desired concentration.

<Processing Example 3: Recovered Liquid of Still Lower Concentration>

FIG. 11 is a diagram showing the example 3 of the control process when the developer supplied as the concentration adjusting solution has a concentration still lower than the level of the aforementioned processing example 2.

Immediately after the start of supply of the recovered liquid as the concentration adjusting solution (Step S11 of FIG. 8), the detection value P and the OF value are acquired in Step S12.

The detection value P is still small (Step S21: YES) at the time of start. Recovered liquid is supplied in the high-speed supply mode (Step S24). Because the liquid volume is small and the OF value is OFF (Step S31: NO), the process goes back to Step S12, and the aforementioned steps are repeated.

Since the supplied liquid has a considerably low concentration, an increase in the detection value P takes too much time. When the time is T31, the liquid overflows while the detection value P is considerably small, and the OF value is turned ON (Step S31: YES).

Since the detection value P is below the forced discharge level Fo (Step S32: YES), supplies of all the liquids are stopped, and the concentration adjusting solution is forcibly discharged (Step S33). In this case, a predetermined volume of solution is forcibly ejected. In FIG. 11, the solution is discharged until the detection value P is reduced by half. However, the entire solution can be discharged.

Further, the detection value reflects just the concentration of the concentration adjusting solution when the OF value is ON. Thus, the volume to be discharged is more preferably determined based on that concentration and the concentration of the high-concentration liquid to be supplied after discharge.

When the time is T32 when the forced discharge is terminated, the supply of the high-concentration liquid (the first supply liquid) starts (Step S34). The detection value P has been reduced by the forced discharge and the OF value has turned OF again. Accordingly, the liquid is supplied in the high-speed supply mode (Step S24).

After that, control is provided in the same procedure as that of supplying the high-concentration liquid in the example 2 of the control process.

For example, when the time is T33, the detection value P is large (Step S21: NO) (Step S22: YES), and the recovered liquid supply shifts to the standard supply mode (Step S25). The liquid volume is still small and the OF value is OFF (Step S31: NO). Accordingly, the system goes back to the Step 12 and these steps are repeated.

The procedure thereafter is the same as that of the example 2 of the control process, and will not be described to avoid duplication.

This concludes the description of the example 3 wherein the concentration of the developer supplied as the concentration adjusting solution is lower than that of the example 2 of the control process.

According to the apparatus and method for adjusting concentration of liquid developer as an embodiment of the present invention, utilization of overflow from the concentration adjusting container eliminates the need of control to keep the liquid volume constant. Along with concentration adjustment by using supply developer, concentration measurement can be made, and the time and effort to measure and move the developer can be reduced. Further, in the control of concentration adjustment, if concentration adjustment by the supply developer is started before start of the overflow, the volume of the required supply developer can be reduced independently of the initial concentration of the developer, and a desired concentration can be obtained with higher efficiency in a shorter period of time.

It is to be expressly understood that the applicable range of the present invention is not restricted to the aforementioned embodiment. The present invention can be embodied in a great number of variations with appropriate modification or additions, without departing from the spirit and scope of the invention claimed.

What is claimed is:

1. A liquid developer concentration adjusting apparatus, comprising:

a concentration adjusting container having an opening;

a developer supplying mechanism which is connected to the concentration adjusting container and is adapted to supply a liquid developer whose concentration is to be adjusted into the concentration adjusting container;

a first liquid supplying mechanism which is connected to the concentration adjusting container and is adapted to supply a first supply liquid, whose concentration is higher than a desired liquid developer concentration, to the concentration adjusting container at a variable supply speed;

a second liquid supplying mechanism which is connected to the concentration adjusting container and is adapted to supply a second supply liquid, whose concentration is lower than the desired liquid developer concentration, to the concentration adjusting container at a variable supply speed;

a stirring mechanism which is adapted to stir the liquid developer stored in the concentration adjusting container, wherein the liquid developer is raised along the sidewall;

a physical property detector which is adapted to detect, when the stirring mechanism is stirring the liquid developer, a stirring load as a physical property which depends on concentration of the liquid developer in the concentration adjusting container;

an OF detector which is adapted to detect a presence or absence of overflow of the liquid developer, which is raised along the sidewall to a level defined by a position of the opening, through the opening; and a controller which is adapted to control a supply speed of the first supply liquid supplied by the first liquid supplying mechanism or the second supply liquid supplied by the second liquid supplying mechanism, depending on the presence or absence of the overflow detected by the OF detector and the physical property detected by the physical property detector, so as to cause the physical property detected under the presence of the overflow to be a target value corresponding to the desired concentration.

2. The liquid developer concentration adjusting apparatus of claim 1, wherein the developer supplying mechanism is adapted to supply the liquid developer whose concentration is to be adjusted at a variable supply speed, and the controller is adapted to control the supply speed of the liquid developer supplied by the liquid developer supplying mechanism depending on the output of the OF detector.

3. The liquid developer concentration adjusting apparatus of claim 1, wherein the controller obtains the output of the OF detector when the first liquid supplying mechanism or the second liquid supplying mechanism is supplying the first supply liquid or the second supply liquid respectively, and the controller controls the supply speed of the first supply liquid or the second supply liquid depending on the output of the OF detector.

4. The liquid developer concentration adjusting apparatus of claim 1, wherein the controller controls the supply speed of the first supply liquid or the second supply liquid to be lower as the physical property detected by the physical property detector gets closer to the target value.

5. The liquid developer concentration adjusting apparatus of claim 1, wherein the controller controls the supply speed of the first supply liquid or the second supply liquid to be lower when the OF detector detects a presence of the overflow.

6. The liquid developer concentration adjusting apparatus of claim 1, comprising: a developer discharging mechanism which is connected to the concentration adjusting container and is adapted to discharge the liquid developer in the concentration adjusting container, wherein the controller controls the developer discharging mechanism to discharge the liquid developer in the concentration adjusting container when the controller determines, based on the physical property detected by the physical property detector, that the concentration of the liquid developer in the concentration adjusting container is lower than a predetermined value.

7. The liquid developer concentration adjusting apparatus of claim 1, wherein the controller compares the target value with the physical property detected before the overflow is detected, and when the physical property detected before the overflow is detected is greater than the target value, the controller controls the second liquid supplying mechanism to supply the second supply liquid.

8. The liquid developer concentration adjusting apparatus of claim 7, comprising:

a developer discharging mechanism which is connected to the concentration adjusting container and is adapted to discharge the liquid developer in the concentration adjusting container, wherein the controller operates such that:

before the overflow is detected:

the controller compares the target value with the physical property detected before the overflow is detected;

when the physical property detected before the overflow is detected is greater than the target value, the controller controls the second liquid supplying mechanism to supply the second supply liquid;

the controller compares the physical property, detected when the second supply liquid is being supplied, with a second supply liquid stopping level; and when the physical property, detected when the second supply liquid is being supplied, is determined to be lower than the second supply liquid stopping level, the controller stops the supply of the second supply liquid; and after the overflow is detected:

when the physical property detected under the presence of the overflow is greater than a predetermined target value range, the controller causes the second supply liquid to be supplied;

when the physical property detected under the presence of the overflow is within the target value range, the controller stops the supply of the second supply liquid;

when the physical property detected under the presence of the overflow is lower than the target value range and is equal to or higher than a discharge level which is lower than the target value range, the controller causes the first supply liquid to be supplied; and when the physical property detected under the presence of the overflow is lower than the discharge level, the controller controls the developer discharging mechanism to discharge the liquid developer by a predetermined amount, and then the controller causes the first supply liquid to be supplied.

9. The liquid developer concentration adjusting apparatus of claim 1, wherein the first liquid supplying mechanism and the second liquid supplying mechanism supply the first supply liquid and the second supply liquid selectively at a high speed, a standard speed, and a low speed, and the controller controls a supply speed of the first supply liquid and the second supply liquid, in accordance with a difference between the physical property and the target value, such that:

before the overflow is detected, the controller controls the supply speed to be the high speed or the standard speed; and after the overflow is detected, the controller controls the supply speed to be the high speed, the standard speed, or the low speed.

10. The liquid developer concentration adjusting apparatus of claim 1, wherein the developer supply mechanism supplies the liquid developer selectively at a high speed, a standard speed, and a low speed, and the controller controls a supply speed of the liquid developer, in accordance with a difference between the physical property and the target value, such that:

before the overflow is detected, the controller controls the supply speed to be the high speed or the standard speed; and after the overflow is detected, the controller controls the supply speed to be the high speed, the standard speed, or the low speed.

11. A liquid developer concentration adjusting apparatus, comprising:

a concentration adjusting container having an opening;

a developer supplying mechanism which is connected to the concentration adjusting container and is adapted to supply a liquid developer whose concentration is to be adjusted into the concentration adjusting container;

a first liquid supplying mechanism which is connected to the concentration adjusting container and is adapted to supply a first supply liquid, whose concentration is higher than a desired liquid developer concentration, to the concentration adjusting container at a variable supply speed;

a second liquid supplying mechanism which is connected to the concentration adjusting container and is adapted to supply a second supply liquid, whose concentration is lower than the desired liquid developer concentration, to the concentration adjusting container at a variable supply speed;

a physical property detector which is adapted to detect a physical property which depends on concentration of the liquid developer in the concentration adjusting container;

an OF detector which is adapted to detect a presence or absence of overflow of the liquid developer through the opening; and a controller which is adapted to control a supply speed of the first supply liquid supplied by the first liquid supplying mechanism or the second supply liquid supplied by the second liquid supplying mechanism depending on an output of the OF detector, wherein the developer supplying mechanism is adapted to supply the liquid developer whose concentration is to be adjusted at a variable supply speed, and the controller is adapted to control the supply speed of the liquid developer supplied by the developer supplying mechanism depending on the output of the OF detector, and wherein the controller controls the supply speed of the liquid developer supplied by the developer supplying mechanism to be lower as the physical property detected by the physical property detector reaches closer to a target value.

12. A method for adjusting concentration of liquid developer, the method comprising:

supplying a liquid developer whose concentration is to be adjusted to a concentration adjusting container having a sidewall and an opening;

supplying a first supply liquid whose concentration is higher than a desired liquid developer concentration to the concentration adjusting container;

supplying a second supply liquid whose concentration is lower than the desired liquid developer concentration to the concentration adjusting container;

stirring the liquid developer stored in the concentration adjusting container, wherein the liquid developer is raised along the sidewall;

detecting, when stirring the liquid developer, a stirring load as a physical property which depends on concentration of the liquid developer in the concentration adjusting container;

detecting a presence or absence of overflow of the liquid developer, which is raised by the stirring along the sidewall up to a level defined by a position of the opening, through the opening; and controlling a supply speed of the first supply liquid or the second supply liquid, based on the physical property detected during the detecting a stirring load process and the presence or absence of the overflow, so as to cause the physical property detected under the presence of the overflow to be a target value corresponding to the desired concentration.

13. The method of claim 12, comprising: controlling a supply speed of the liquid developer, whose concentration is to be adjusted, being supplied to the concentration adjusting container.

14. The method of claim 12, wherein the detecting the physical property and the detecting the presence or absence of the overflow are executed while supplying the first supply liquid or the second supply liquid.

15. The method of claim 12, wherein during the controlling a supply speed process, the supply speed of the first supply liquid or the second supply liquid is controlled to be lower as the detected physical property gets closer to the target value.

16. The method of claim 12, wherein during the controlling a supply speed process, the supply speed of the first supply liquid or the second supply liquid is controlled to be lower when the overflow is detected.

17. The method of claim 12, comprising-determining whether a concentration of the liquid developer in the concentration adjusting container is higher or lower than a predetermined value, based on the detected physical property; and discharging the liquid developer in the concentration adjusting container when the concentration of the liquid developer is determined to be lower than the predetermined value.

18. The method of claim 12, comprising:

comparing the target value with the physical property detected before the overflow is detected; and supplying the second supply liquid when the physical property detected before the overflow is detected is greater than the target value.

19. The method of claim 12, comprising:

discharging the liquid developer in the concentration adjusting container, wherein before the overflow is detected:

comparing the target value with the physical property detected before the overflow is detected;

when the physical property detected before the overflow is detected is greater than the target value, supplying the second supply liquid;

comparing the physical property detected when the second supply liquid is being supplied with a second supply liquid stopping level which is smaller than the target value; and when the physical property detected when the second supply liquid is being supplied is lower than the second liquid stopping level, stopping the supply of the second supply liquid, and wherein after the overflow is detected:

comparing a predetermined target value range with the physical property detected after the overflow is detected;

when the physical property detected after the overflow is detected is greater than the predetermined target value range, supplying the second supply liquid;

when the physical property detected after the overflow is detected is within the predetermined target value range, stopping the supply of the second supply liquid;

when the physical property detected after the overflow is detected is lower than the predetermined target range and is equal to or higher than a discharge level which is smaller than the predetermined target range, supply the first supply liquid; and when the physical property detected after the overflow is detected is lower than the discharge level, discharging the liquid developer in the concentration adjusting container by a predetermined amount, and then supplying the first supply liquid.

20. The method of claim 12, wherein in the supplying a first supply liquid and the supplying a second supply liquid, the first supply liquid and the second supply liquid are supplied selectively at a high speed, a standard speed, and a low speed, in accordance with a difference between the physical property and the target value, and before the overflow is detected, the first supply liquid or the second supply liquid is supplied at the high speed or the standard speed; and after the overflow is detected, the first supply liquid or the second supply liquid is supplied at the high speed, the standard speed, or the low speed.

21. The method of claim 12, wherein in the supplying a liquid developer, the liquid developer is supplied selectively at a high speed, a standard speed, and a low speed, in accordance with a difference between the physical property and the target value, and before the overflow is detected, the developer is supplied at the high speed or the standard speed; and after the overflow is detected, the liquid developer is supplied at the high speed, the standard speed, or the low speed.

22. A method for adjusting concentration of liquid developer, the method comprising:

supplying a liquid developer whose concentration is to be adjusted to a concentration adjusting container having an opening;

supplying a first supply liquid whose concentration is higher than a desired liquid developer concentration to the concentration adjusting container;

supplying a second supply liquid whose concentration is lower than the desired liquid developer concentration to the concentration adjusting container;

detecting a physical property which depends on concentration of the liquid developer in the concentration adjusting container;

detecting a presence or absence of overflow of the liquid developer through the opening; and controlling a supply speed of the first supply liquid or the second supply liquid based on the physical property and the detected presence or absence of the overflow, wherein, during the controlling a supply speed process, the supply speed of the liquid developer whose concentration is to be adjusted to be lower as the detected physical property gets closer to a target value.

* * * * *